US008794023B2

(12) United States Patent
Nuss

(10) Patent No.: US 8,794,023 B2
(45) Date of Patent: Aug. 5, 2014

(54) ICE DISPENSER WITH CRUSHER FOR A REFRIGERATOR APPLIANCE

(75) Inventor: Bart Andrew Nuss, Fisherville, KY (US)

(73) Assignee: General Electric Company, Schenectady, NY (US)

( * ) Notice: Subject to any disclaimer, the term of this patent is extended or adjusted under 35 U.S.C. 154(b) by 297 days.

(21) Appl. No.: 13/285,122

(22) Filed: Oct. 31, 2011

(65) Prior Publication Data

US 2013/0105611 A1 May 2, 2013

(51) Int. Cl.
*F25C 5/02* (2006.01)

(52) U.S. Cl.
USPC ..... 62/320; 62/340

(58) Field of Classification Search
CPC ..... F25C 5/02; F25C 1/08; F25C 3/00; F25C 1/10; F25C 1/147
USPC ..... 62/320, 340, 344, 354; 222/80, 146.6
See application file for complete search history.

(56) References Cited

U.S. PATENT DOCUMENTS

| | | | | |
|---|---|---|---|---|
| 4,084,725 | A | 4/1978 | Buchser | |
| 5,056,688 | A * | 10/1991 | Goetz et al. | 222/146.6 |
| 6,082,130 | A | 7/2000 | Pastryk et al. | |
| 6,442,954 | B1 * | 9/2002 | Shapiro et al. | 62/137 |
| 6,952,936 | B2 * | 10/2005 | Sannasi et al. | 62/344 |
| 7,111,473 | B2 * | 9/2006 | Chung et al. | 62/320 |
| 7,395,672 | B2 * | 7/2008 | Krause et al. | 62/66 |
| 7,509,818 | B2 * | 3/2009 | Anselmino et al. | 62/344 |
| 7,571,619 | B2 * | 8/2009 | Park et al. | 62/320 |
| 7,698,901 | B2 * | 4/2010 | Koons et al. | 62/137 |
| 7,703,298 | B2 * | 4/2010 | Lee et al. | 62/344 |
| 7,743,622 | B2 * | 6/2010 | Fischer et al. | 62/344 |
| 7,779,641 | B2 * | 8/2010 | Lee et al. | 62/137 |
| 7,797,961 | B2 * | 9/2010 | An et al. | 62/353 |
| 7,963,120 | B2 * | 6/2011 | An et al. | 62/344 |
| 2006/0059939 | A1 | 3/2006 | An et al. | |

* cited by examiner

*Primary Examiner* — Mohammad M Ali
(74) *Attorney, Agent, or Firm* — Dority & Manning, P.A.

(57) ABSTRACT

An ice dispenser for a refrigeration appliance is provided that can deliver both crushed ice and whole or non-crushed ice. A rotating drum or cylinder carries one or more blades that can crush ice against non-rotating blades carried on an axis or rod that extends into the drum. The direction of rotation of the drum can be selected so as to determine whether crushed or non-crushed ice is dispensed. The dispensing system can be located on the door of the refrigerator. An ice maker can also be positioned with the ice dispenser on the door of the appliance or, optionally, can be located in a compartment of the refrigerator.

20 Claims, 7 Drawing Sheets

ICE DISPENSER WITH CRUSHER FOR A REFRIGERATOR APPLIANCE

FIELD OF THE INVENTION

The subject matter of the present disclosure relates to an ice dispenser for a refrigerator appliance and, more specifically, to an ice dispenser having an ice crusher.

BACKGROUND OF THE INVENTION

Generally, a refrigerator includes a freezer compartment and a fresh food compartment, which are partitioned from each other to store various foods at appropriate low temperatures. It is common to provide an automatic icemaker/water dispenser with a refrigerator. In a "side-by-side" type of refrigerator where the freezer compartment is arranged to the side of the fresh food compartment, the icemaker is usually disposed in the freezer compartment and, thus, utilizes the cold air in the freezer compartment, which typically includes an evaporator also disposed in the freezer compartment.

In a "bottom freezer" type of refrigerator where the freezer compartment is arranged beneath a top mounted fresh food compartment, convenience necessitates that the icemaker is disposed in a sub-compartment (often referred to as an "icebox") that is usually thermally insulated and configured in one of the top mounted fresh food compartment doors with ice delivered through an opening on the door. In such an arrangement, provision must be made for providing adequate refrigeration to the icebox to enable the icemaker to form and store the ice. An access door is commonly provided on the icebox to allow the consumer to access the internal ice bucket and icemaker.

Typically, the ice maker delivers ice into a storage container or bucket where the ice is kept until used. A panel on the front of the refrigerator allows the user to select between the dispensing of crushed ice or non-crushed ice. Conventionally, the ice is pushed by e.g., an auger through a chute or channel equipped with a one or more blades, which are carried on a shaft and rotate with the shaft to contact and crush the ice. Chilled water can also be provided by routing a thermally conductive conduit to the panel such that the water is cooled before reaching the dispenser.

The ice container and dispenser can consume a significant amount of space from the freezer or fresh food compartment. Space is consumed not only by the volume required for ice creation and storage, but the mechanisms for moving and/or crushing the ice can also consume space the user might otherwise prefer to have available for food storage. Additionally, the mechanisms needed for crushing ice can also consume additional space. Depending upon how the components are positioned within these compartments, user access to portions of the compartment and/or to the ice storage container (e.g., for cleaning or manually collecting ice) can be inconvenient as well.

Accordingly, an ice dispensing system for a refrigerator appliance would be useful. More particularly, an ice dispensing system for a refrigerator appliance that can allow for the positioning of the ice storage container and/or ice crushing mechanism on a door of the refrigerator would be beneficial as it could provide savings in space. Additionally, such a system that can provide more convenient access to the refrigerator compartments and/or the ice storage container would be also be useful.

BRIEF DESCRIPTION OF THE INVENTION

Aspects and advantages of the invention will be set forth in part in the following description, or may be obvious from the description, or may be learned through practice of the invention.

In an exemplary embodiment, the present invention provides an ice dispensing assembly for an appliance. The assembly includes a container for the receipt of ice. The container has a bottom defining an opening for the passage of ice from the container. A rotatable cylinder is positioned below the container at the opening defined by the bottom of the container. The cylinder has a wall and defines a diameter. The rotatable cylinder includes one or more rotatable blades connected to the wall of the cylinder and extending along the diameter. An axis extends into the rotatable cylinder. The axis carries one or more non-rotatable blades extending between the axis and the wall of the cylinder. A motor is in mechanical communication with the rotatable cylinder and is configured to selectively cause the rotatable cylinder to rotate about the axis.

In another exemplary embodiment, the present invention provides a refrigerator. The refrigerator includes a cabinet, a fresh food compartment, a freezer compartment, or both. An ice maker is also included along with an ice dispensing assembly. The ice dispensing assembly includes a container for the receipt of ice from the ice maker. The container has a bottom. A drum is positioned at the bottom of the container for the receipt of ice from the container. A rotatable blade extends along a diameter of the drum and is attached to the drum. An axis is positioned within the drum. The axis extends through an opening defined by the rotatable blade whereby said rotatable blade may rotate around the axis. A non-rotatable blade is attached to the axis. The drum is rotatable about the axis in both a clockwise and counter clockwise direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 4:
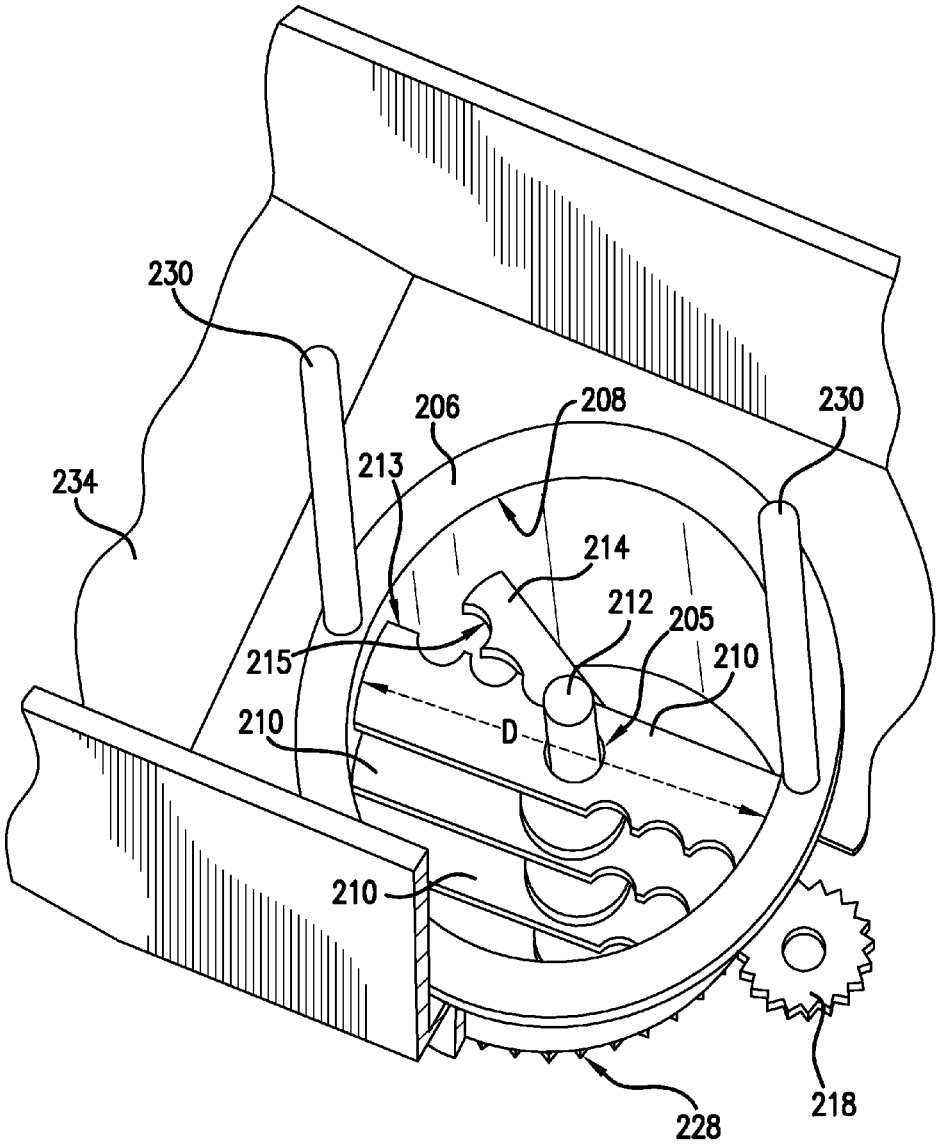
FIG. 4 illustrates the bottom of the ice storage container of FIG. 3, including a top down view of an exemplary embodiment of a rotating cylinder or drum for the crushing of ice. Again, a portion of the storage container is removed for purposes of more clearly describing the present invention. Additionally, a top cover that is positioned over the drum has been removed to reveal blades in the drum; the top cover is shown in FIG. 6.
Figure 5:
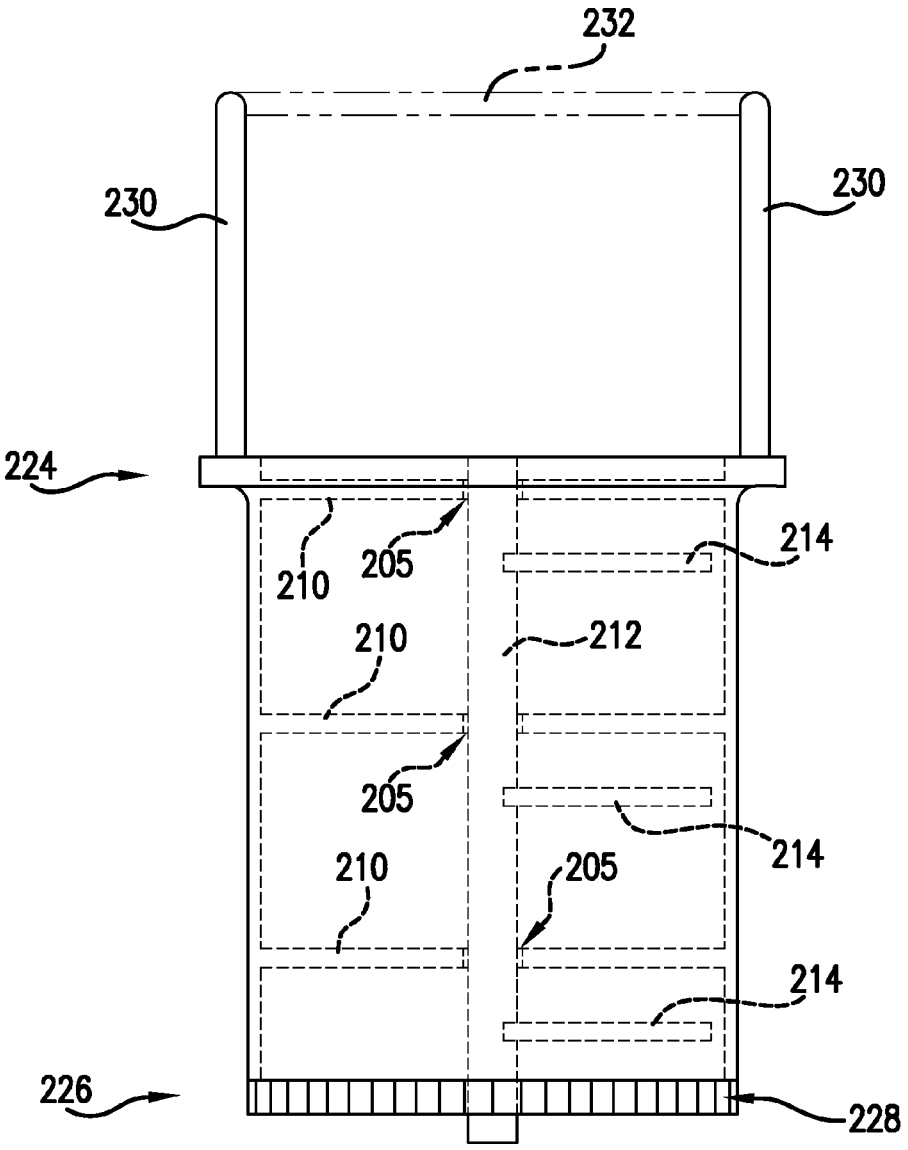

A cross-sectional view of the exemplary cylinder or drum of FIG. 4 is shown in FIG. 5.

Figure 6:
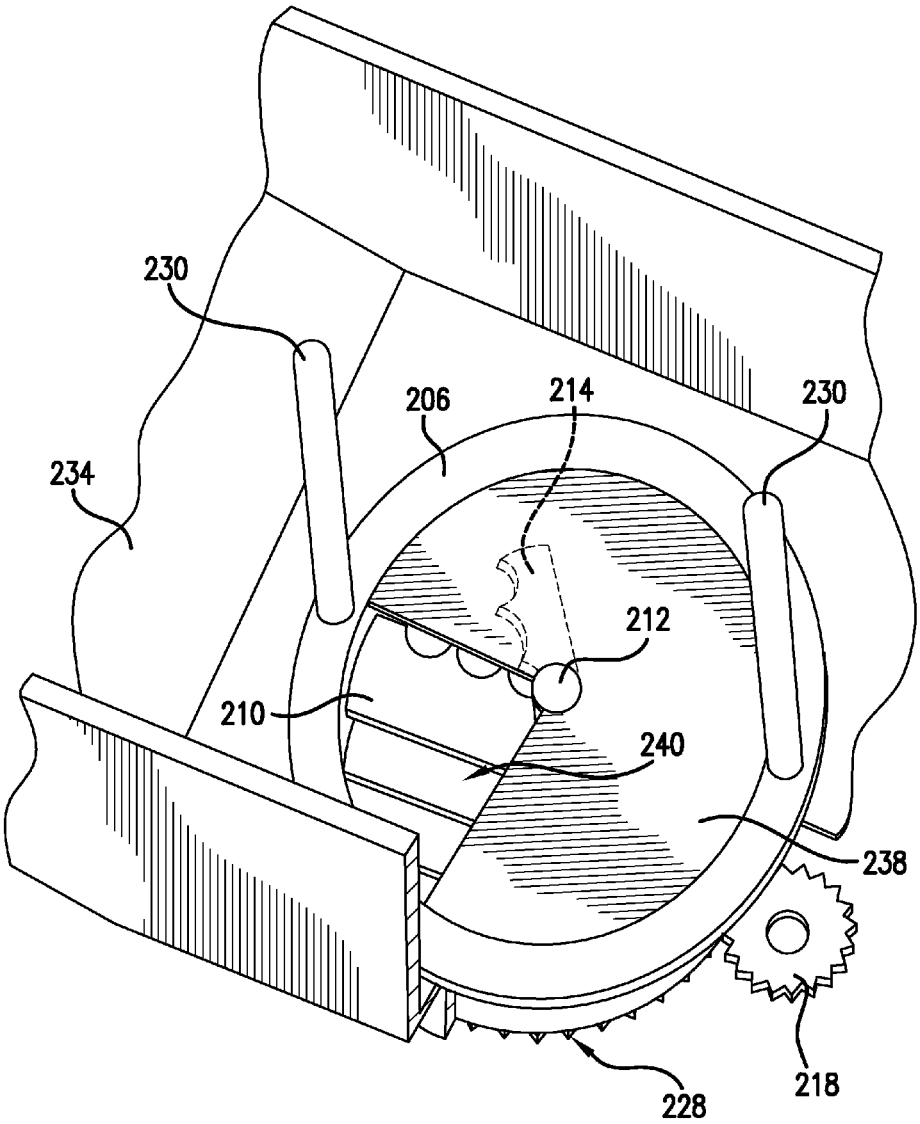

FIG. 6 provides the same view as FIG. 4 except a cover is shown in place at the top of the rotating cylinder as will be further described below.

Figure 3:
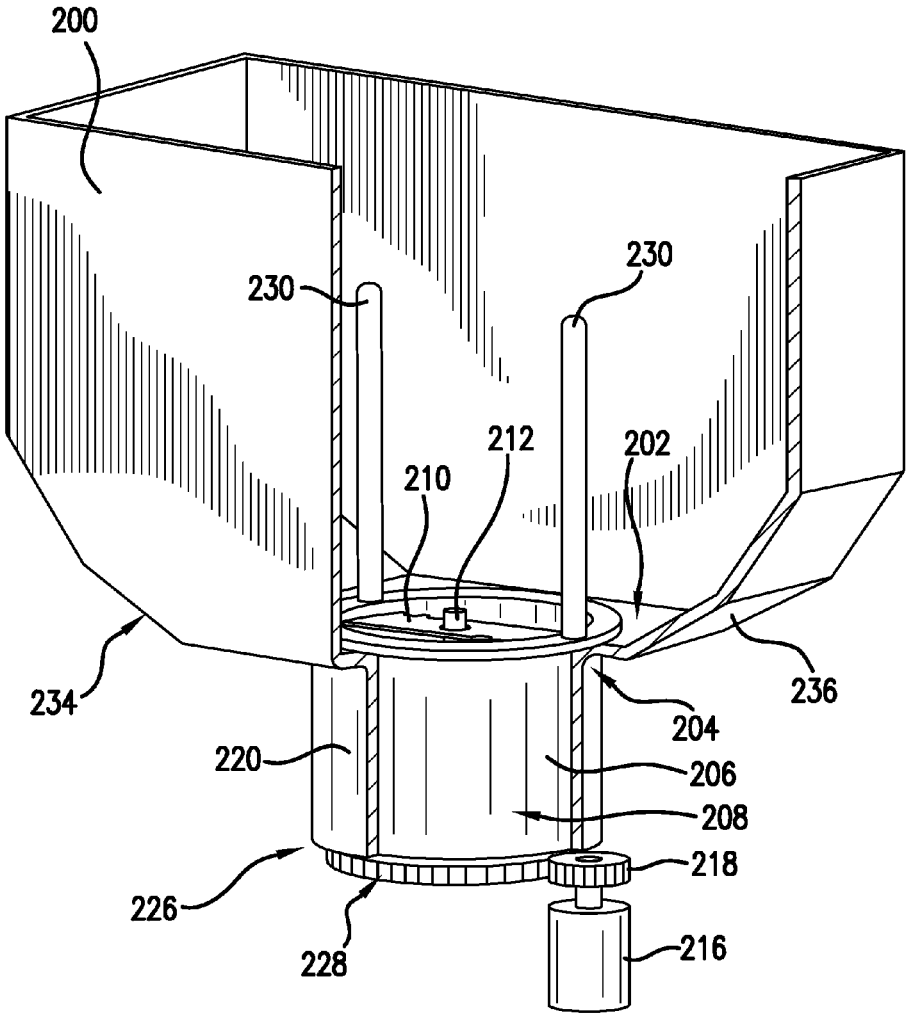
FIG. 3 depicts a perspective view of an ice storage container and crusher in an exemplary embodiment of an ice dispensing assembly of the present invention. For purposes of revealing interior components in this view, a portion of the storage container is removed.
Figure 7:
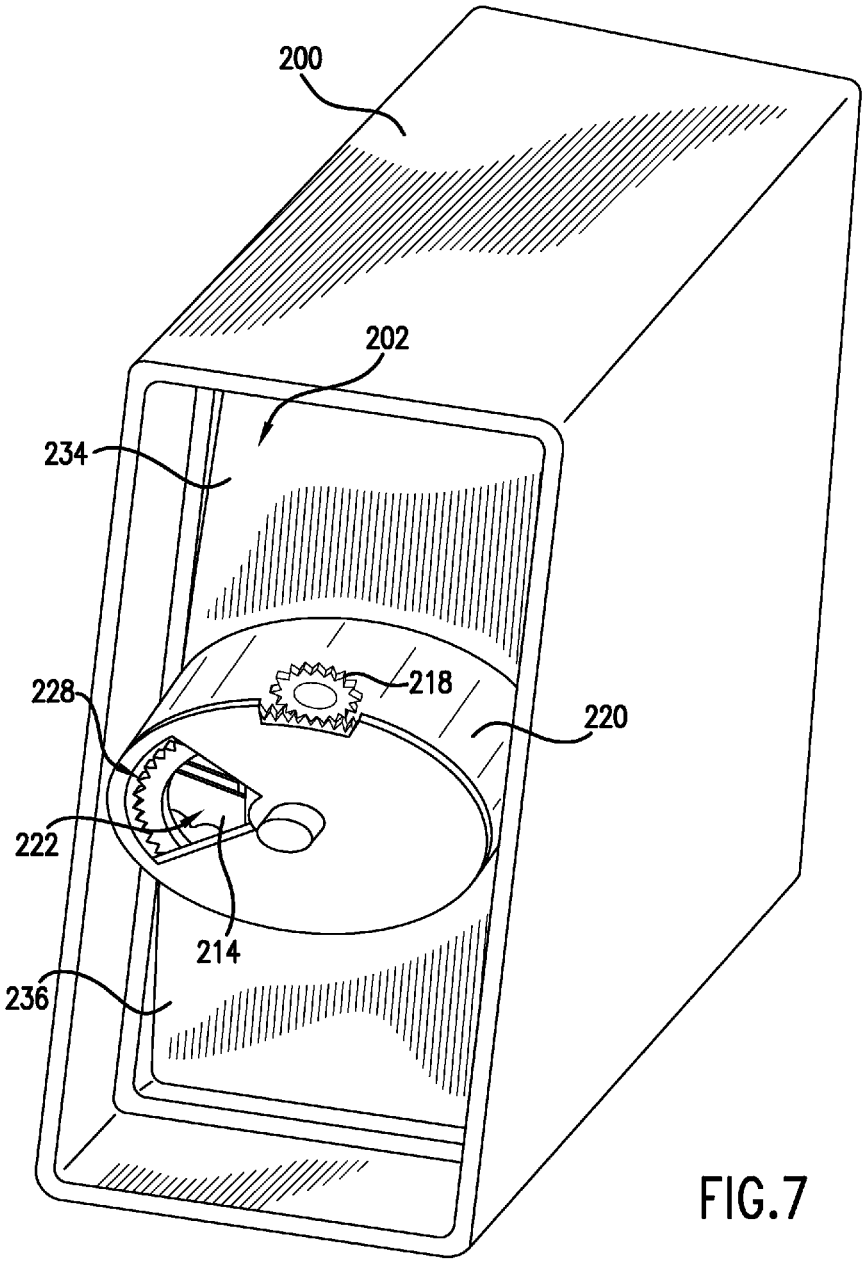

FIG. 7 is a perspective view of the bottom of the exemplary ice storage container of FIG. 3.

DETAILED DESCRIPTION OF THE INVENTION

The present invention provides an ice dispensing system for a refrigeration appliance. The ice dispensing system includes a mechanism for crushing ice such that both crushed ice or non-crushed ice can be dispensed to a user of the appliance. A rotating drum or cylinder carries one or more blades that can crush ice against non-rotating blades carried on an axis or rod that extends into the drum. The direction of rotation of the drum can be selected so as to determine whether crushed or non-crushed ice is dispensed. The dispensing system can be located on the door of the refrigerator. An ice maker can also be positioned with the ice dispenser on the door of the appliance or, optionally, can be located in a compartment of the refrigerator.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 1:
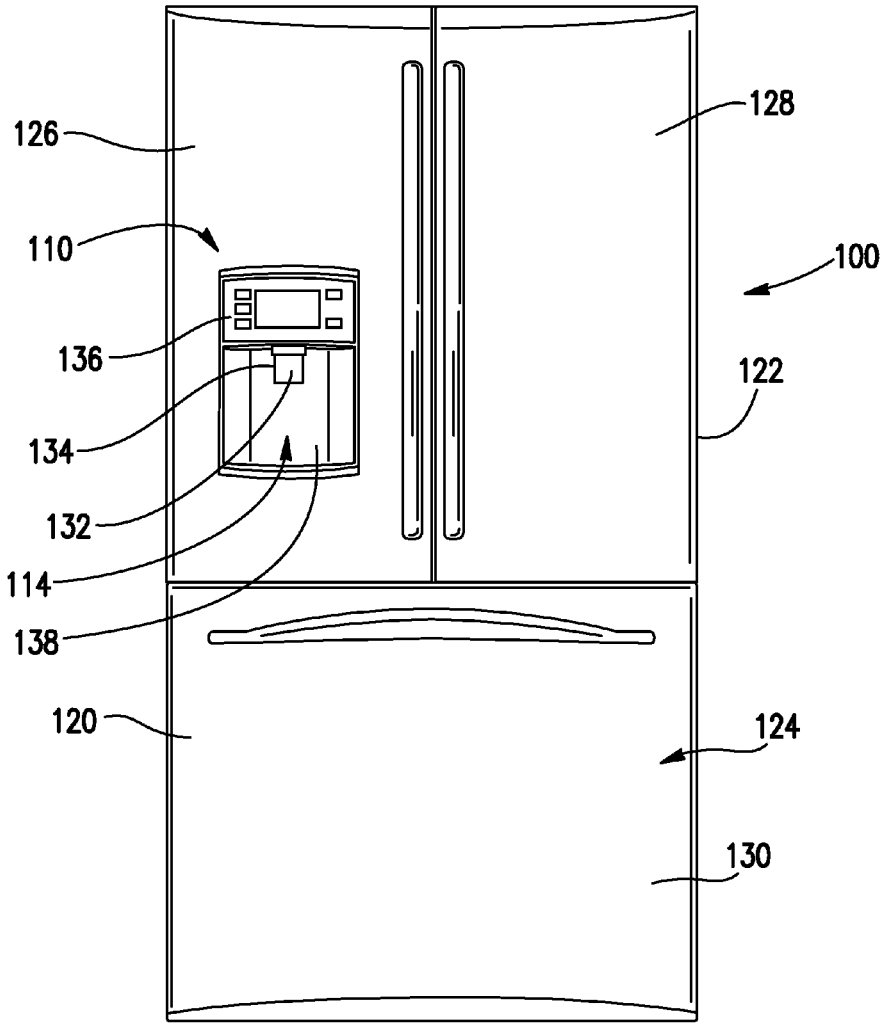
FIG. 1 illustrates an exemplary embodiment of a refrigerator appliance as may be used with the present invention.

FIG. 1 is a front view of a refrigerator 100 including an ice-dispensing assembly 110 for dispensing water and/or ice. In this exemplary embodiment, ice-dispensing assembly 110 includes a dispenser 114 positioned on an exterior portion of refrigerator 100. Refrigerator 100 includes a housing 120 defining an upper fresh food compartment 122 and a lower freezer compartment 124 arranged at the bottom of refrigerator 100. As such, refrigerator 100 is generally referred to as a bottom mount refrigerator. In the exemplary embodiment, housing 120 also defines a mechanical compartment (not shown) for receipt of a sealed cooling system. Using the teachings disclosed herein, one of skill in the art will understand that the present invention can be used with other types of refrigerators (e.g., side-by-sides) as well. Consequently, the description set forth herein is for illustrative purposes only and is not intended to limit the invention in any aspect.

Refrigerator doors 126, 128 are rotatably hinged to an edge of housing 120 for accessing fresh food compartment 122. A freezer door 130 is arranged below refrigerator doors 126, 128 for accessing freezer compartment 124. In the exemplary embodiment, freezer door 130 is coupled to a freezer drawer (not shown) slidably coupled within freezer compartment 124.

For this exemplary embodiment, dispenser 114 includes a discharging outlet 132 for accessing ice and water. A single paddle 134 is mounted below discharging outlet 132 for operating dispenser 114. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 132 and paddle 134 are an external part of dispenser 114, and are mounted in a concave portion 138 defined in an outside surface of refrigerator door 126. Concave portion 138 is positioned at a predetermined elevation convenient for a user to access ice or water enabling the user to access ice without the need to bend-over and without the need to access freezer compartment 124. In the exemplary embodiment, concave portion 138 is positioned at a level that approximates the chest level of a user.

Figure 2:
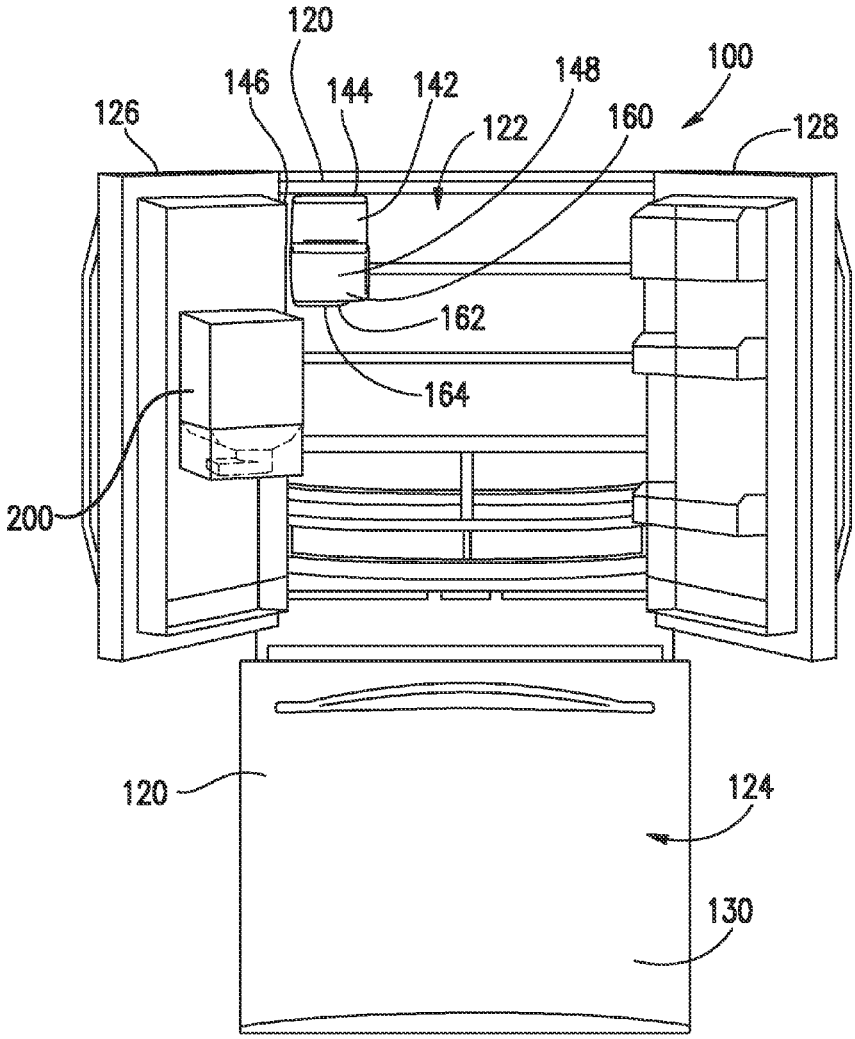
FIG. 2 provides another illustration of the exemplary embodiment of FIG. 1 with doors to the fresh food compartment shown in an open position.

FIG. 2 is a perspective view of refrigerator 100 having doors 126, 128 in an open position to reveal the interior of the fresh food compartment 122. As such, certain components of this exemplary embodiment of the ice dispensing assembly 110 are illustrated. Ice-dispensing assembly 110 includes an insulated housing 142 mounted within refrigerator compartment 122 along an upper surface 144 of compartment 122 and along a sidewall 146 of compartment 122. Insulated housing 142 includes insulated walls 148 defining an insulated cavity (not shown). Due to the insulation which encloses the cavity, the temperature within the cavity can be maintained at levels different from the ambient temperature in the surrounding fresh food compartment 122.

In this exemplary embodiment, the insulated cavity is constructed and arranged to operate at a temperature that facilitates producing and storing ice. More particularly, the insulated cavity contains an ice maker for creating ice and feeding the same to a container 200 that is mounted on refrigerator door 126. As illustrated in FIG. 2, container 200 is placed at a vertical position on refrigerator door 126 that will allow for the receipt of ice from a discharge opening 162 located along a bottom edge 164 of insulated housing 142. As door 126 is closed or opened, housing 200 is moved in and out of position under insulated housing 142. Alternatively, in another exemplary embodiment of the present invention, insulated housing 142 and its ice maker can be positioned directly on door 126. In still another embodiment of the present invention, in a configuration where the fresh food compartment and the freezer compartment are located side by side (as opposed to over and under as shown in FIGS. 1 and 2), the ice maker could be located on the door for the freezer compartment and directly over container 200. As such, the use of an insulated housing would be unnecessary. Other configurations for the location of ice container 200, an ice maker, and/or insulated housing 142 may be used as well.

Operation of the refrigerator 100 can be regulated by a controller (not shown) that is operatively coupled to user interface panel 136 and/or paddle 134. Panel 136 provides selections for user manipulation of the operation of refrigerator 100 such as e.g., selections between whole or crushed ice, chilled water, and/or other options as well. In response to user manipulation of the user interface panel 136, the controller operates various components of the refrigerator 100. The controller may include a memory and one or more microprocessors, CPUs or the like, such as general or special purpose microprocessors operable to execute programming instructions or micro-control code associated with operation of refrigerator 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator 100. In the illustrated embodiment, the controller may be located within the control panel area of door 126. In such an embodiment, input/output ("I/O") signals may be routed between the controller and various operational components of refrigerator 100 such as a motor for rotating components of an ice crusher as will be described further below. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

An exemplary embodiment of the ice storage container 200 along with an ice crushing mechanism as may be used with ice dispensing assembly 110 is further illustrated in FIG. 3. For purposes of revealing interior components in this view, a portion of the storage container 200 and a cover 238 (shown in FIG. 6 only) is removed. Container 200 has a bottom 202 that defines an opening 204 whereby ice may pass from container 200 and into a drum or rotatable cylinder 206. Bottom 202 contains sloped walls 234 and 236 that help direct ice towards opening 204. As shown, drum 206 is positioned below container 200 and at opening 204.

Referring now to FIGS. 3 through 6, drum 206 has an outer cylindrical wall 208 and defines a diameter D. Multiple rotatable blades 210 are connected to wall 208 and extend along diameter D as best seen in FIG. 4. Although multiple rotatable blades 210 are preferred, one or more such blades may be used. As will be further described, rotatable blades 210 rotate with drum 206 as it rotates about an axis 212 located in middle of drum 206. More specifically, axis 212 extends into drum 206 but is not connected with rotatable blades 210. Each rotatable blade 210 defines an opening 205 through which the axis 212 extends such that blades 210 can freely rotate about axis 212 in either a clockwise or counter-clockwise direction. As best viewed in FIGS. 3 and 7, a housing 220 extends from the bottom 202 of container 200. Housing 220 at least partially encloses rotatable drum 206, and a portion of axis 212 extends into housing 220 (see FIG. 7).

Multiple non-rotatable blades 214 are attached to axis 212 and are not connected to the wall 208 of drum 206. As the axis 212 is not rotatable, blades 214 are also not rotatable within drum 206. Non-rotatable blades 214 remain in a fixed position relative to rotatable blades 210. Although multiple non-rotatable blades 214 are preferred, one or more such blades may be used.

As shown in FIGS. 3 and 6, blades 210 and 214 each have cutting edges 213 and 215 that are oriented towards each other. As such, from the perspective of FIGS. 3 and 6, when drum 206 is rotated in a clockwise direction, cutting edges 213 and 215 are moved towards each other to crush ice that has fallen into a position between blades 210 and 214. Conversely, when drum 206 is rotated in a counter-clockwise direction, cutting edges 213 and 215 move away from each other such that non-crushed or whole ice passes vertically under the force of gravity through drum 206.

Continuing specifically with FIGS. 3 and 6, drum 206 has a top end 224 and a bottom end 226. Top end 224 has a pair of tines 230 extending vertically therefrom. As drum 206 is rotated, tines 230 contact ice in container 200 to stir and thereby "fluidize" the same so that the ice may more readily flow into drum 206. A cover 238 is positioned at the top end 224 of drum 206. Although two tines 240 are shown, one or more tines may be used with the present invention and may located in different locations on top end 224. Different shapes and configurations for tines 230 may be used as well. For example, tines 230 may be connected by e.g., an extension 232 that extends between tines 230 at or near their distal ends.

For purposes of clarity in showing other components, cover 238 is shown only in FIG. 6 and has been removed in the other figures. Notably, cover 238 is attached to axis 212 and not to drum 206. As such, cover 238 remains stationary and does not rotate with drum 206. Cover 238 also defines a first aperture 240 through which ice must pass in order to travel from container 200 and through drum 206.

As best seen in FIG. 3, bottom end 226 of drum 206 is configured with a plurality of gear teeth 228 that are positioned along a circumference of drum 206. A motor 216 is provided in mechanical communication with drum 206 through gear teeth 228 and a gear 218 connected with motor 216. By way of example, motor 216 may be selectively operated by the controller discussed above. Based on whether whole or crushed ice has been selected by a user of the appliance, the controller can direct the rotation of the gear 218 by motor 216 and thereby control the direction of rotation of drum 206 to provide ice as selected. The motor and gear configuration of FIG. 3 is provided by way of example only; multiple other configurations for rotating drum 206 may be used as well.

Bottom end 226 of housing 220 also includes a second aperture 222 through which ice must pass in order to exit drum 206. The position of first aperture 240 and second aperture 222 are offset with respect to axis 212. Stated alternatively, it is preferable that first aperture 240 not be located directly over second aperture 222 along the vertical direction of axis 212. In this way, by controlling the size and relative positioning of apertures 222 and 240, ice entering into drum 206 will be forced to make contact with blades 210 and 214 as the ice travels through drum 206.

By way of example of the operation of ice dispensing assembly 110, ice is dropped into container 200 from the ice maker through opening 162 in insulated housing 142. Sloped walls 234 and 236 help direct ice toward first aperture 240 so that ice may move through aperture 240 and opening 204 and into drum 206 under the force of gravity. Depending upon whether the user has selected crushed or whole ice using interface panel 136, a controller can determine the direction of rotation of drum 206. Such rotation could be activated based upon e.g., the depressing of paddle 134 by a user such that a request for ice is received by the controller. The controller could then activate motor 216 appropriately.

The rotation of drum 206 by activation of motor 216 also rotates tines 230 so as to stir ice in container 200. If the user has selected crushed ice, drum 206 is rotated so that the movement of rotatable blades 210 relative to the non-rotating blades 214 will pinch and then crush ice between the cutting edges 213 and 215 (clockwise as viewed in FIG. 4). As ice travels vertically down through drum 206, multiple blades 210 and 214 can be provided as shown so as to help ensure that the ice is crushed sufficiently. Alternatively, if the user has selected whole or non-crushed ice, drum 206 is rotated so that the movement of rotatable blades 210 relative to non-rotating blades 213 will avoid crushing ice therebetween (counter-clockwise as viewed in FIG. 4). After travelling down drum 206, ice can exit through second aperture 222 and pass through discharge outlet 132 into e.g., the user's cup or glass.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispensing assembly for an appliance, comprising:

a container for the receipt of ice, said container having a bottom defining an opening for the passage of ice from said container;

a drum comprising a rotatable cylinder configured for receipt of ice from said container, said cylinder positioned below said container at the opening defined by the bottom of the container; said cylinder having a wad and defining a diameter, said rotatable cylinder including one or more rotatable blades connected to the wall of the cylinder and extending along the diameter said cylinder having a top end and a bottom end;

at least one tine extending from the top end of said cylinder;

an axis extending into said rotatable cylinder, said axis carrying one or more non-rotatable blades extending between the axis and the wall of the cylinder; and a motor in mechanical communication with said rotatable cylinder and configured to selectively cause said rotatable cylinder to rotate about said axis.

2. The ice dispensing assembly as in claim 1, further comprising a housing extending from the bottom of said container and at least partially enclosing said rotatable cylinder, said axis supported by said housing.

3. The ice dispensing assembly as in claim 1, wherein said housing defines at least one aperture for the passage of ice from said rotatable cylinder.

4. The ice dispensing assembly as in claim 1, wherein said rotatable cylinder has a top end and a bottom end, and wherein the bottom end is configured with gear teeth positioned along a circumference of said rotatable cylinder and in mechanical communication with said motor.

5. The ice dispensing assembly as in claim 4, wherein at least one tine is positioned along the top end of said cylinder for contacting ice from said container.

6. The ice dispensing assembly as in claim 1, wherein said at least one tine comprises a pair of tines extending from the top end of said cylinder.

7. The ice dispensing assembly as in claim 6, wherein said pair of tines are connected by an extension connected near the top of said pair of tines.

8. The ice dispensing assembly as in claim 1, wherein the bottom of the container is sloped towards the opening defined by the bottom.

9. The ice dispensing assembly as in claim 1, wherein said motor causes said rotatable cylinder to rotate in one direction for crushed ice and to rotate in an opposite direction for non-crushed ice.

10. The ice dispensing assembly as in claim 1, further comprising a cover positioned at the top end of said rotatable cylinder, said cover defining an aperture for the passage of ice from said container and into said rotatable cylinder.

11. The ice dispensing assembly as in claim 1, further comprising a cover positioned at the top end of said rotatable cylinder, said cover defining a first aperture for the passage of ice from said container and into said rotatable cylinder; and, a housing extending from the bottom of said container and at least partially enclosing said rotatable cylinder, said axis supported by said housing, said housing defining, a second aperture for the passage of ice from said rotatable cylinder.

12. The ice dispensing assembly as in claim 1, wherein said one or more rotatable blades are each configured with a cutting edge that is positioned towards a cutting edge of said one or more non-rotatable blades.

13. A refrigerator, comprising:

a cabinet;

a fresh food compartment, a freezer compartment, or both;

an ice maker;

an ice dispensing assembly, comprising:

a container for the receipt of ice from said ice maker, said container having a bottom;

a rotatable drum positioned at the bottom of said container for the receipt of ice from said container;

at least one tine extending away from said drum and into said container, said at least one tine configured for stirring ice during rotation of said drum;

a rotatable blade extending along a diameter of the drum and attached to the drum;

an axis positioned within said drum, said axis extending through an opening defined by said rotatable blade whereby said rotatable blade may rotate around said axis; and a non-rotatable blade attached to the axis;

wherein said drum is rotatable about said axis in both a clockwise and counter clockwise direction.

14. The refrigerator as in claim 13, further comprising a motor in mechanical communication with said drum and configured for rotating said drum about said axis.

15. The refrigerator as in claim 14, further comprising at least one processing device in communication with said motor and configured for controlling said motor so as to determine the direction of rotation of said drum depending upon whether the dispensing of ice or crushed ice has been selected by a user.

16. The refrigerator as in claim 13, wherein said drum has a top end and a bottom end, and further comprising a cover positioned at the top end of said drum, said cover defining an aperture for the passage of ice from said container into said rotatable drum.

17. The refrigerator as in claim 13, further comprising a housing that encloses at least a portion of said drum, said housing defining an aperture fix the passage of ice from said drum.

18. The refrigerator as in claim 13, wherein the bottom of said container defines an opening for the passage of ice, and wherein the bottom is sloped towards the opening so as to assist in directing the flow ice towards the opening.

19. An ice dispensing assembly for an appliance, comprising:

a container for the receipt of ice, said container having a bottom defining an opening for the passage of ice from said container;

a drum comprising a rotatable cylinder having a top end that is open for the receipt of ice into the cylinder through the opening of said container, the cylinder positioned below said container and at the opening defined by the bottom of the container, said cylinder having a wall and defining a diameter, said rotatable cylinder including one or more rotatable blades connected to the wall of the cylinder and extending along the diameter;

an axis extending into said rotatable cylinder, said axis carrying one or more non-rotatable blades extending between the axis and the wall of the cylinder; and a motor in mechanical communication with said rotatable cylinder and configured to selectively cause said rotatable cylinder to rotate about said axis.

20. The ice dispensing assembly of claim 19, further comprising at least one tine extending from the top end of said cylinder.

* * * * *